US006552283B2

(12) United States Patent
Cabrera et al.

(10) Patent No.: US 6,552,283 B2
(45) Date of Patent: Apr. 22, 2003

(54) ACTIVATION FLOW SWITCH FOR TANKLESS WATER HEATERS

(76) Inventors: Carlos Cabrera, 6900 NW. 72 Ave., Miami, FL (US) 33166; Michael Brooks, 3462 Irwin Ave., Mims, FL (US) 32754

( * ) Notice: Subject to any disclaimer, the term of this patent is extended or adjusted under 35 U.S.C. 154(b) by 14 days.

(21) Appl. No.: 09/769,161

(22) Filed: Jan. 24, 2001

(65) Prior Publication Data

US 2002/0096420 A1 Jul. 25, 2002

(51) Int. Cl.[7] ..... H01H 36/02
(52) U.S. Cl. ..... 200/81.9 M; 200/84 C
(58) Field of Search ..... 200/84 C, 81.9 M, 200/82 E

(56) References Cited

U.S. PATENT DOCUMENTS 3,564,171 A * 2/1971 Hammond ..... 200/89.1 M
4,647,740 A * 3/1987 Hansen, III et al. ..... 200/84 C
4,900,896 A 2/1990 Maus
5,091,612 A 2/1992 Van Fossen
5,170,462 A * 12/1992 Park ..... 392/492
5,408,578 A * 4/1995 Bolivar ..... 392/490
5,479,558 A 12/1995 White, Jr. et al.

FOREIGN PATENT DOCUMENTS

JP 5-290698 * 5/1993 ..... 200/84 R

* cited by examiner

*Primary Examiner*—Renee Luebke
(74) *Attorney, Agent, or Firm*—Lott & Friedland, P.A.

(57) ABSTRACT

A flow switch for use in tankless water heaters. The present invention is an activation flow switch for tankless water heaters. More specifically, the flow switch is comprised of polypropylene balls through which is inserted a magnet. The balls have a specific gravity less than water and are therefore buoyant. When flow through the water pipe commences, the flow switch raises in the flow switch cylinder thereby bringing the magnet into operative connection with a relay switch. The relay switch, once activated, signals to the water heater that hot water is required which in turn activates the heating elements of the water heater. Once the flow in the pipe subsides, the flow switch returns to its inactive position, thereby deactivating the water heater.

4 Claims, 3 Drawing Sheets

ACTIVATION FLOW SWITCH FOR TANKLESS WATER HEATERS

FIELD OF INVENTION

The present invention relates generally to tankless water heaters, and, more particularly, the present invention relates to a flow switch that functions to turn the electronic controls of a water heater on and off.

BACKGROUND OF THE INVENTION

Every household and many businesses require hot water for everyday use. These hot water consumers typically rely on conventional storage water heaters to store and constantly heat water for production upon demand.

A variety of fuel options are available for conventional storage water heaters, including electricity, natural gas, oil, and propane. Ranging in size from 20 to 80 gallons (75.7 to 302.8 liters), storage water heaters remain the most popular type for residential heating needs in the United States. A storage heater operates by releasing hot water from the top of the tank when the hot water tap is turned on. To replace that hot water, cold water enters the bottom of the tank, ensuring that the tank is always full.

Because the water is constantly heated in the tank, energy can be wasted even when no faucet is on. This is called standby heat loss. It is possible to completely eliminate standby heat losses from the tank and reduce energy consumption 20% to 30% with demand (tankless) water heaters, which do not have storage tanks. Cold water travels through a pipe into the unit, and either a gas burner or an electric element heats the water only when needed.

Tankless water heaters save energy because they do not need to constantly heat water in a large storage tank. To achieve this, tankless water heaters instantaneously heat water as it is passing from the consumer's water supply to the outlet (e.g. faucet or showerhead). The tankless water heater, therefore, needs to "know" when hot water is in demand in order to function properly. Flow switches are used to signal the tankless water heater that the consumer desires hot water. Briefly, when a consumer turns on a faucet or a dishwasher, any hot-water-requiring device, water flows from the water supply through the tankless water heater system. This flow of water causes the flow switch to activate the heating element (e.g. gas or electric) of the tankless water heater.

Previous attempts have been made to provide effective flow switches for use in tankless water heaters such as are described in U.S. Pat. No. 4,900,896 to Maus ('896 patent); U.S. Pat. No. 5,091,612 to Van Fossen ('612 patent); U.S. Pat. No. 5,408,578 to Bolivar ('578 patent); and U.S. Pat. No. 5,479,558 to White, Jr. et al. ('558 patent); all of which are incorporated herein by reference.

The '896 patent describes a continuous flow water heater which has a sealed chamber containing an electrical heating element and a diaphragm having an orifice through which water must flow upon a demand for hot water. The center of the diaphragm translates axially in response to the water flow and moves an internal magnet, which influences an external magnet to throw a flow switch. A heat sink made from a material exhibiting high thermal conductivity extends from within the sealed chamber to a position in heat exchanging relationship with a thermostat, the contacts of which are closed unless the water exceeds a set value. The flow switch and thermostat are in series with a source of electricity and the heating element such that the heating element is only energized if there is water flow through the heater and if the exiting water does not exceed a selected temperature. The sealed chamber is contained within a housing made of heat-resistant plastic. A plurality of opposed pairs of longitudinally extending grooves are formed in the housing, and a mounting bracket is provided for detachably snapping into one of the pairs of grooves to allow the heater to be mounted in a variety of different orientations.

The '612 patent describes a flow switch adapted to be attached to a pipe is designed to trip a switch at a preset flow rate. The switch employs a bending metal blade which deflects in the flow stream to move a magnet attached to the downstream side of the blade relative to a reed switch or Hall-effect switch. The switching device is preferably mounted in a slot on a printed circuit board to enable selection of a range of available trip points.

The '578 patent describes a continuous flow water heater assembly requiring no storage tank and including an entrance chamber having a flow control switch mounted therein adapted to be activated upon a positive flow of water through the system wherein the water flows from the entrance chamber to a plurality of heating elements each of which are at least partially segregated by virtue of their being removably mounted within separate heating chambers. The heating chambers are attached in fluid communication to one another by a plurality, at least two, ports which are of proportionately different sizes such that water will be passed between the first and second heating chambers in a proportionately different amounts through the different sized ports. Water is thereby effectively distributed between the heating elements so as to prevent exposure of the heating elements when activated and thereby eliminating either of the heating elements from being exposed to air and thereby subject to burnout.

The '558 patent describes a very compact tankless water heater delivers heat in proportion to demand. A flow responsive valve energizing an electrical control system is purely flow responsive, even to minute flow, and consumes no power when dormant. An uncomplicated electronic control system is connected to power by the flow switch, and is substantially de-energized when dormant. Most electronic components of the control system are mounted on the flat front wall of the pressure vessel. Thus, overall dimensions are minimized, cool water serves as a heat sink, and heat generated by electronic controls is captured for heating purposes. In particular, triacs controlling the heating elements are cooled, thus prolonging their life. A preferred embodiment of the novel heater has a maximum electrical consumption of 22 kilowatts, with equivalent heat output, and has overall external dimensions of 24 inches in height, 5.5 inches in width, and 4 inches in depth (61 cm in height, 14 cm in width, and 10 cm in depth). An outlet pipe fitting extending above adds approximately 2 inches (5 cm) to the overall height, enabling the water heater to be installed in a typical building interior wall or partition.

Many of the above-described inventions employ flow switches that are mechanical in nature. Mechanical flow switches are at risk of breakdown and can be rendered ineffective by particulate matter in the fluid flow. In addition, many of these flow switches are manufactured of material subject to corrosion and decay. For example, the '896 patent relies on a diaphragm to sense water flow, thereby actuating a system of magnets whereby the flow switch is activated. The '612 patent, although employing magnetic principles, relies on a metal blade to sense flow through the pipe. The '578 patent uses a magnetic flow switch that slides along the interior of a narrow pipe in response to fluid flow. This type of flow switch would be rendered inoperable by particulate matter prohibiting such movement. Similarly, the '558 patent relies on water flow to move a plunger which in turn causes a level arm to activate a circuit. As with the '578 patent, particulate matter in the flow can lodge itself between the plunger and the pipe wall, thereby "sticking" the plunger in the open position even once the flow has subsided.

Consequently, there is a need in the art for a tankless water heater flow switch that is resistant to corrosive materials.

There is a further need in the art for a tankless water heater flow switch that reduces the likelihood of performance breakdown as a result of particulate matter buildup.

There is a further need in the art for a tankless water heater flow switch that provides consistent control performance regardless of the flow rate.

SUMMARY OF THE INVENTION

The present invention solves significant problems in the art by providing a tankless water heater flow switch that is resistant to corrosive substances and provides steady control performance.

In a preferred embodiment of the invention, what is provided is an activation flow switch for a tankless water, comprising a magnet for activating a relay switch, whereby the relay switch is operatively connected to the water heater for water temperature control purposes; and a means for providing buoyancy for the flow switch.

In an alternate embodiment, the invention is an activation flow switch for a tankless water heater, comprising a magnet for activating a relay switch, whereby the relay switch is operatively connected to the water heater for water temperature control purposes; and at least one sphere, whereby the magnet is inserted through the center of the sphere.

In another alternate embodiment, what is provided is an activation flow switch for a tankless water heater, comprising a magnet for activating a relay switch, whereby the relay switch is operatively connected to the water heater for water temperature control purposes; and three vertically connected spheres, whereby the magnet is inserted through the center of the spheres, the top-most sphere being of a larger diameter than the bottom two spheres.

This invention is directed to a tankless water heater flow switch that is resistant to corrosive substances and provides steady control performance.

Accordingly, it is an object of the present invention to provide a tankless water heater flow switch that is resistant to corrosive materials.

It is another object of the present invention to provide a tankless water heater flow switch that reduces the likelihood of performance breakdown as a result of particulate matter buildup.

It is another object of the present invention to provide a tankless water heater flow switch that provides consistent control performance regardless of the flow rate.

DETAILED DESCRIPTION OF THE PREFERRED EMBODIMENT

Figure 1:
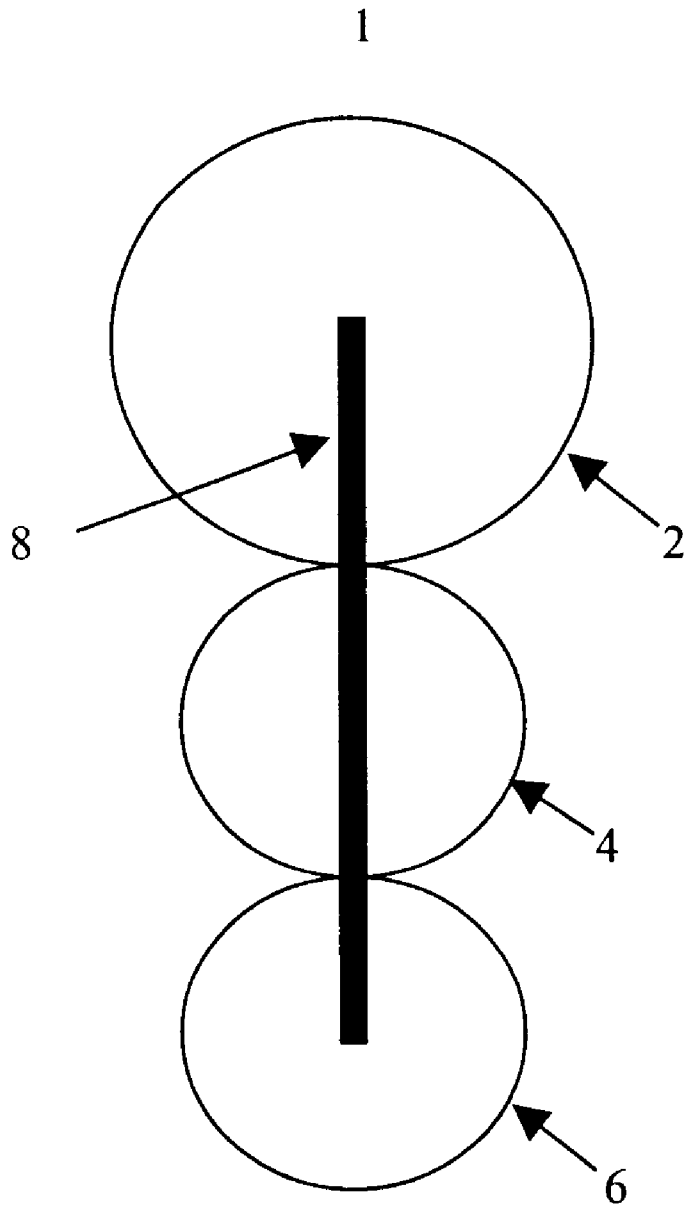
FIG. 1 is a profile view of a preferred embodiment of the tankless water heater flow switch according to the invention.

Referring initially to FIG. 1 of the drawings, in which like numerals indicate like elements throughout the several views, in a preferred embodiment the flow switch 1 is composed of three polypropylene spheres 2, 4, 6. Polypropylene is used because its specific gravity is less than water's, thereby enabling the flow switch 1 buoyancy in water. Conceivably any material with a specific gravity less than water could be used; however, polypropylene is preferred because it is inexpensive and resistant to most acid and alkaline. The upper sphere 2 has a larger diameter than the other two spheres 4, 6. A magnet 8 for activating a relay switch 10, shown in FIGS. 2 and 3, is inserted through the center of the spheres 2, 4, 6.

Figure 2:
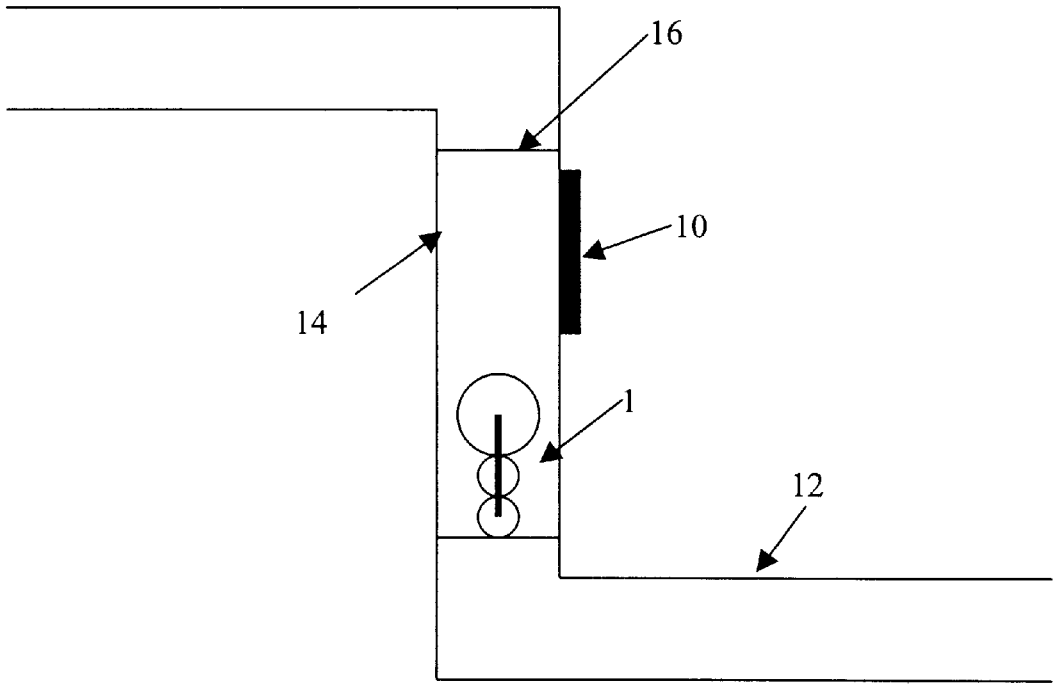
FIG. 2 is an illustration of a preferred embodiment of the flow switch at rest according to the invention.

FIG. 2 is a representation of the flow switch 1 at rest, or when there is no flow through the water heater. The flow switch cylinder 14 holds the flow switch 1 in place regardless of flow through the water pipe 12 through the use of mesh screens 16 or a similar device. The screens not only hold the flow switch 1 in the flow switch cylinder 14, but they also act to filter out particulate matter that could interfere with the operation of the flow switch system.

Figure 3:
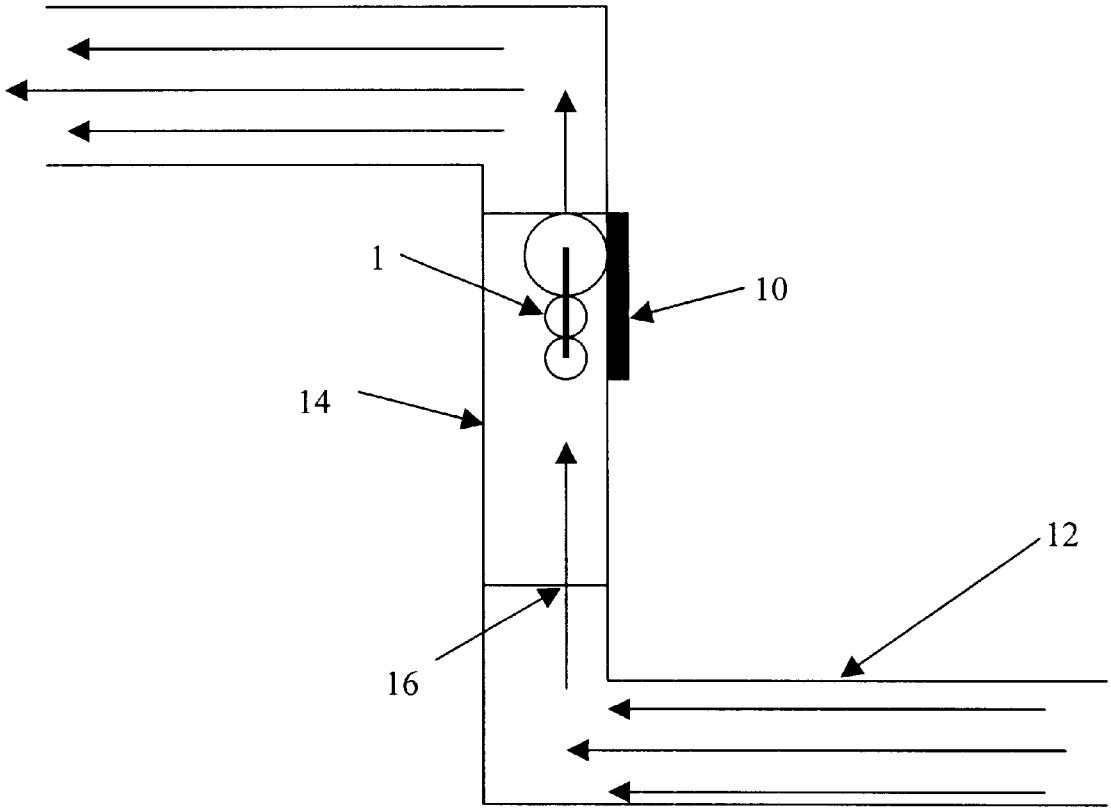
FIG. 3 is an illustration of a preferred embodiment of the flow switch in operation according to the invention.

Turning to FIG. 3, the flow switch 1 is shown in operation, while there is flow through the water pipe 12. A larger upper sphere 2 provides a steadier flow switch 1 when there is heavy flow through the water pipe 12. The electronic control performance of the water heater is improved when the flow switch 1 is steady. In addition, use of a larger upper sphere 2 reduces rotation of the flow switch 1 about its vertical axis, further enhancing steady electronic control performance and also reducing the noise the flow switch 1 makes in the flow switch cylinder 14 when subject to flow. As water flow enters the flow switch cylinder 14 from the water pipe 12, the flow switch 1 begins to rise as result of its buoyant characteristics. As the flow switch 1 rises, the magnet 8 embedded therein establishes a position opposite the relay switch 10. This "connected" relationship between the magnet 8 and the relay switch 10 allows for the electronic control circuitry of the water heater to enable the heating elements. As FIG. 3 demonstrates, the flow switch 1 rises up to the point it is allowed by the mesh screen 16. Once the water flow is turned off, the flow switch 1 drops down in the flow switch cylinder 14, thereby disengaging from the relay switch 10 and operatively deactivating the heating elements. The mesh screen 16 allows the flow switch 1 to drop out of contact with the relay switch 10, but not too far down the pipe 12.

Accordingly, it will be understood that the preferred embodiment of the present invention has been disclosed by way of example and that other modifications and alterations may occur to those skilled in the art without departing from the scope and spirit of the appended claims.

What is claimed is:

1. An activation flow switch for a tankless water heater, comprising:

a magnet for activating a relay switch, whereby said relay switch is operatively connected to said water heater for water temperature control purpose; and at least two spheres, whereby said magnet is inserted through the center of each of said spheres and at least one of said spheres is larger than the other sphere.

2. A flow switch of claim 1, wherein at least one of said spheres is manufactured of polypropylene material.

3. An activation flow switch for a tankless water heater, comprising:

a magnet for activating a relay switch, whereby said relay switch is operatively connected to said water heater for water temperature control purposes; and three vertically connected spheres, whereby said magnet is inserted through the center of said spheres, the top-most sphere being of a larger diameter than the bottom two spheres.

4. A flow switch of claim 3, wherein said spheres are manufactured of polypropylene material.

* * * * *